US012698548B2

(12) United States Patent
Bertheville et al.

(10) Patent No.: US 12,698,548 B2
(45) Date of Patent: Aug. 4, 2026

(54) COMPONENT FOR TIMEPIECE OR PIECE OF JEWELLERY MADE OF CERMET

(71) Applicant: The Swatch Group Research and Development Ltd, Marin (CH)

(72) Inventors: Bernard Bertheville, Sion (CH); Yann Fallet, Savagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 576 days.

(21) Appl. No.: 18/004,691

(22) PCT Filed: Jun. 17, 2021

(86) PCT No.: PCT/EP2021/066498
§ 371 (c)(1),
(2) Date: Jan. 9, 2023

(87) PCT Pub. No.: WO2022/017697
PCT Pub. Date: Jan. 27, 2022

(65) Prior Publication Data

US 2023/0250517 A1 Aug. 10, 2023

(30) Foreign Application Priority Data

Jul. 22, 2020 (EP) ..... 20187228

(51) Int. Cl.
*C22C 29/06* (2006.01)
*A44C 27/00* (2006.01)
(Continued)

(52) U.S. Cl.
CPC ..... *C22C 29/067* (2013.01); *A44C 27/003* (2013.01); *B22F 7/06* (2013.01); *C22C 29/08* (2013.01); *C22C 29/10* (2013.01)

(58) Field of Classification Search
CPC ..... C22C 29/067
See application file for complete search history.

(56) References Cited

U.S. PATENT DOCUMENTS 1,984,203 A * 12/1934 Sieger ..... B22F 3/26 29/874
2,180,826 A 11/1939 Hensel et al.
(Continued)

FOREIGN PATENT DOCUMENTS

CH 512 952 9/1971
CN 1177384 A 3/1998
(Continued)

OTHER PUBLICATIONS

International Search Report issued Feb. 8, 2022 in PCT/EP2021/066498 filed Jun. 17, 2021, 3 pages.
(Continued)

*Primary Examiner* — Jophy S. Koshy
*Assistant Examiner* — Joshua S Carpenter
(74) *Attorney, Agent, or Firm* — Oblon, McClelland, Maier & Neustadt, L.L.P.

(57) ABSTRACT

A component suitable for a timepiece or a jewellery item may be made of a cermet material including a carbide phase and a metal binder phase selected from among gold, platinum, palladium rhodium, osmium, ruthenium, and one of the alloys thereof. The metal binder phase may be present in a range of from 3 and 25 wt. % and the carbide phase may be present in a range of from 75 and 97 wt. %.

21 Claims, 2 Drawing Sheets

(51) Int. Cl.

| | |
|---|---|
| ***B22F 7/06*** | (2006.01) |
| ***C22C 29/08*** | (2006.01) |
| ***C22C 29/10*** | (2006.01) |

(56) References Cited

U.S. PATENT DOCUMENTS

| | | | | | |
|---|---|---|---|---|---|
| 3,049,753 | A * | 8/1962 | Ogden | C22C 29/067 | 425/464 |
| 3,892,644 | A * | 7/1975 | Borg | B22F 9/04 | 423/440 |
| 5,603,075 | A | 2/1997 | Stoll et al. | | |
| 2006/0086441 | A1* | 4/2006 | Lin | C22C 5/02 | 148/678 |
| 2008/0176063 | A1 | 7/2008 | Lin et al. | | |
| 2012/0304694 | A1* | 12/2012 | Derrig | A44C 27/00 | 63/35 |
| 2014/0374171 | A1* | 12/2014 | Thomas | B28B 1/008 | 175/425 |

FOREIGN PATENT DOCUMENTS

| | | | | | |
|---|---|---|---|---|---|
| CN | 109778044 | A | | 5/2019 | |
| FR | 1.007.173 | | | 5/1952 | |
| FR | 1.210.728 | | | 3/1960 | |
| FR | 2 487 380 | | | 1/1981 | |
| GB | 1309634 | A | * | 3/1973 | C22C 29/06 |
| JP | 2002-105577 | A | | 4/2002 | |
| WO | WO 2019/170200 | A1 | | 9/2019 | |

OTHER PUBLICATIONS

Chinese Office Action and Search Report issued Apr. 26, 2024 in corresponding Chinese Patent Application No. 202180060014.0 (with partial English translation and Translation of Category of Cited Documents), 8 pages.

* cited by examiner

COMPONENT FOR TIMEPIECE OR PIECE OF JEWELLERY MADE OF CERMET

CROSS-REFERENCE TO RELATED APPLICATIONS

The present application is the national stage of international application PCT/EP2021/066498, filed on Jun. 17, 2021, and claims the benefit of the filing date of European Appl. No. 20187228.0, filed on Jul. 22, 2020.

TECHNICAL FIELD

The present invention relates to a component in particular for a timepiece or piece of jewellery, made of a cermet type material with a ceramic phase comprising carbides and with a metallic binder comprising a precious metal.

PRIOR ART

Many external part components are made of gold or a gold alloy. Gold has the advantage of having a high ductility as well as a high malleability, which enables easy shaping. It furthermore has a very high and characteristic metallic brilliance. Moreover, the different gold alloys can take on various tints ranging from white to red. However, gold and the alloys thereof have the disadvantage of having a low hardness which is at most 300 HV. In this regard, various ceramic composites have been developed in order to increase the hardness of gold. The manufacturing process most often consists of infiltrating a high-hardness matrix with gold and applying very high pressures. The disadvantage of this process is that accessible shapes remain limited to simple geometries, obtaining complex shapes requiring the use of additional machining methods. Further processes as disclosed in the document WO 2004/005561 consist of using gold as a metallic binder in a cermet obtained by sintering. The gold metallic binder is present in proportions well above 50% by weight. In this case, the hardness of such a precious cermet is low and inversely proportional to the weight percentage of gold. Generally, cermets use a non-precious metal as a binder. This often involves allergenic elements such as nickel or cobalt as disclosed in the document U.S. Pat. No. 4,589,917, or iron-based alloys inducing a low corrosion resistance and a high ferromagnetism.

SUMMARY OF THE INVENTION

The aim of the present invention is that of overcoming the disadvantages cited above by proposing a cermet with an optimised composition to meet the following criteria:

- having a high metallic brilliance,
- having a minimum hardness of 700 HV30,
- avoiding the use of allergenic elements such as nickel or cobalt,
- not having ferromagnetism and being resistant to saline corrosion.

For this purpose, the present invention proposes a component for a timepiece or piece of jewellery made of a cermet material including a carbide phase and a phase of a metallic binder chosen from silver, gold, platinum, palladium, ruthenium, osmium, rhodium and one of the alloys thereof. The metallic binder phase is present in a weight percentage between 3 and 25% and the carbide phase is present in a weight percentage between 75 and 97%.

The cermet material thus developed has after polishing a metallic brilliance that can be comparable to that observed in stainless steels, especially when the metallic binder is palladium. These precious cermets have hardnesses between 700 and 1900 HV30 and they have sufficient tenacities for the production of external parts. Moreover, they can be shaped by conventional powder metallurgy processes such as pressing or injection in order to obtain "near-net shape" parts.

The low precious binder content makes it possible to obtain a cermet retaining the reflective and colorimetric characteristics of the carbide used, which is particularly important for external part and decorative components.

The present invention also relates to the process for manufacturing the component comprising the successive steps of:

a) Producing a mixture comprising a carbide powder and a powder of a metallic binder chosen from silver, gold, platinum, palladium, ruthenium, osmium, rhodium and one of the alloys thereof and optionally comprising an additive.

b) Forming a blank by giving said mixture the shape of the component, c) Sintering the blank at a temperature between 1000 and 1900° C. for a period between 30 minutes and 10 hours, the process being characterised in that the carbide powder is present in a weight percentage between 75 and 97%, the metallic binder powder in a weight percentage between 3 and 25% and the additive in a weight percentage between 0 and 4%.

The use of precious binders such as platinum or palladium makes it possible to densify these carbide-based cermets from much lower temperatures than those of said carbides alone and without using sintering at high temperatures and under pressure, i.e. from 1250° C. with palladium and 1400° C. with platinum.

The powders of the mixture preferably have a d50 less than 20 μm, more preferably less than 10 μm and even more preferably less than 5 μm. With a small particle size, the homogeneity of the mixture is improved and excellent coverage of the metallic binder on each carbide grain is ensured. Furthermore, by reducing the size of the carbides, the final density is increased while increasing the mechanical properties such as the hardness and tenacity after sintering. Moreover, reducing the size of the particles makes it possible to obtain a high metallic brilliance, i.e. a high brightness value L*.

Further features and advantages of the present invention will become apparent in the following description of a preferred embodiment, given by way of non-limiting example with reference to the appended drawings.

DETAILED DESCRIPTION

Figure 1:
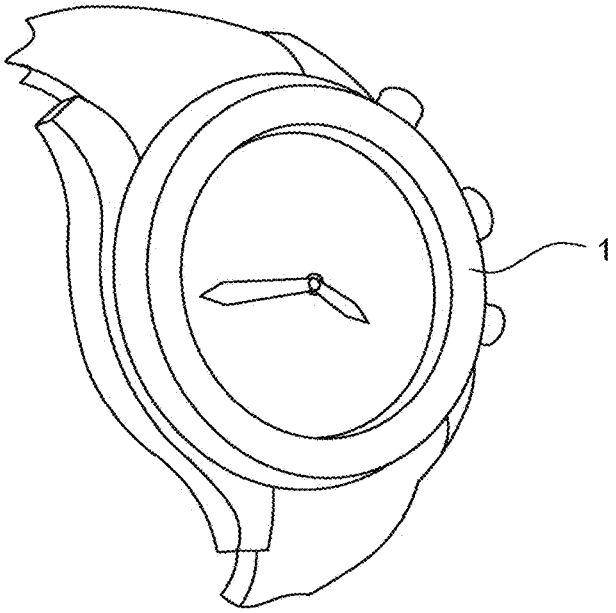
FIG. 1 represents a timepiece comprising a middle made with the cermet type material according to the invention.

The present invention relates to a component particularly for a timepiece or piece of jewellery made of a cermet type material comprising a majority carbide phase and a minority phase of a metallic binder including a precious element such as silver, gold, platinum, palladium, ruthenium, osmium, rhodium or an alloy of one of these precious elements. Preferably, the metallic binder is chosen from silver, gold, platinum, palladium or an alloy of one of these precious elements. The component according to the invention can form a decorative article such as a constituent element of watches, pieces of jewellery, bracelets, etc. In the watchmaking field, this component can be an external part such as a middle, a back, a bezel, a push-piece, a bracelet link, a dial, a hand, a dial index, etc. It can also consist of a component of the movement such as an oscillating mass, a plate, etc. By way of illustration, a middle 1 made with the cermet type material according to the invention is represented in FIG. 1.

The cermet component is produced by sintering from a mixture of the carbide and metallic powders. The manufacturing process includes steps of:

a) Producing a mixture with the different powders, optionally in a wet environment. The powders of the mixture preferably have a d50 less than 20 μm, more preferably less than 10 μm and even more preferably less than 5 μm. The mixture can optionally be produced in a mill to obtain the sought d50. The particle size distribution is measured by laser diffraction in accordance with the standard ISO 13320: 2020.

This mixture contains by weight between 75 and 97%, advantageously between 78 and 97%, and more advantageously between 78 and 94%, of the carbide powder and between 3 and 25%, advantageously between 3 and 22%, and more advantageously between 6 and 22% of the metallic powder. The mixture can optionally contain one or more additives in a weight percentage for all of the additives less than or equal to 4%. In the presence of one or more additives, the latter are preferably present in a percentage for all of the additives between 1 and 3% by weight. More specifically, in the presence of one or more additives, the mixture includes the carbide powder in a weight percentage between 75 and 96%, the metallic binder powder in a weight percentage between 3 and 24% and the additive(s) in a weight percentage for all of the additives between 1 and 3%. These additives are aimed at improving densification during sintering. For example, they may consist of metallic disilicide such as $Si_2Ti$ or $Si_2Zr$.

Preferably, the carbide powder includes one or more carbides chosen from TiC, SiC, $Mo_2C$, WC and NbC. More specifically, the carbide powder contains predominantly titanium carbide (TiC), tungsten carbide (WC) or molybdenum carbide ($Mo_2C$). Predominantly means that, when there are several types of carbides in the powder, titanium carbide (TiC), tungsten carbide (WC) or molybdenum carbide ($Mo_2C$) are present in a greater percentage than the other carbides. It can thus contain $Mo_2C$ and TiC with $Mo_2C$ predominantly present. It can also contain $Mo_2C$ and TiC with TiC predominantly present. It can also contain TiC and SiC with TiC predominantly present. Alternatively, it can, apart from impurities, consist entirely of TiC, WC or $Mo_2C$. The metallic powder contains predominantly palladium, platinum, silver, gold, ruthenium, osmium, rhodium or an alloy of one of these elements. It can, apart from impurities, consist entirely of platinum, palladium, ruthenium, osmium, rhodium or silver. Gold is preferably present in alloyed form with at least one element chosen from Cu, Ag, Pd, In. More specifically, the gold alloy contains gold alloyed with silver and copper (3N yellow gold, 5N red gold) or palladium (white gold). The metallic powder can also contain carbon in a weight percentage between 0.1 and 5% with respect to the total weight of the powder mixture. Indeed, during sintering, some of the $Mo_2C$ can be converted to Mo resulting in a decrease in hardness. Adding carbon makes it possible to limit Mo formation and therefore maintain the hardness level. Alternatively, carbon can be added in the carbide powder. The carbide powder thus contains carbon in a weight percentage between 0.1 and 5% with respect to the total weight of the powder mixture.

By way of example, the powder mixture can contain one of the following distributions by weight:

- between 80 and 95% of TiC and between 5 and 20% of Pd or Pt,
- between 75 and 95% of TiC and between 5 and 25% of an Au alloy,
- between 50 and 70% of TiC, between 5 and 30% of $Mo_2C$, and between 5 and 30% of an Au alloy, preferably between 55 and 65% of TiC, between 10 and 25% of $Mo_2C$, and between 5 and 25% of an Au alloy,
- between 70 and 85% of TiC, between 5 and 10% of $Mo_2C$, and between 5 and 20% of Pd or Pt,
- between 75 and 85% of TiC, between 2 and 10% of SiC, and between 5 and 23% of Pd or Pt,
- between 80 and 97% of $Mo_2C$ and between 3 and 20% of Pd, Pt, Ag or an Au alloy,
- between 75 and 95% of $Mo_2C$ and between 5 and 25% of an Au alloy,
- between 75 and 95% of WC and between 5 and 25% of Pd or Pt,
- between 80 and 95% of WC and between 5 and 20% of an Au alloy.

Optionally, a second mixture comprising the mixture cited above and an organic binder system (paraffin, polyethylene, etc.) can be made.

b) Form a blank by giving the mixture the shape of the desired component, for example, by injection or by pressing in a mould.

c) Sinter the blank in an inert atmosphere or in a vacuum at a temperature between 1000 and 1900° C. for a period between 30 minutes and 10 hours, preferably between 30 minutes and 5 hours. This step can be preceded by one or more debinding steps in a temperature range between 60 and 800° C. if the mixture contains an organic binder system.

The blank thus obtained is cooled and polished. It can also be machined before polishing to obtain the desired component.

The component, which can also be referred to as article, from the manufacturing process contains the carbide phase and the metallic phase in weight percentages close to those of the initial powders. However, it is not possible to rule out slight variations of compositions and percentages between the base powders and the material from the sintering following, for example, contaminations or transformations, for example, $Mo_2C$ to Mo. As such, in the final product from the process, the mass percentages for the different phases must be understood as follows. The carbide phase is distinguished from the metallic phase, also referred to as metallic binder. The carbide phase contains carbides as well as any elements derived from basic carbide powder derivatives such as Mo for the example above. Similarly, for the metallic phase, it contains the compounds of the initial metallic powder as well as an optional compound from a decomposition or reaction of the metallic base powder. In the presence of additives in the powder mixture, the latter can be detected in the carbide phase and/or in the metallic phase.

The component has a CIELAB colour space (according to the CIE No. 15, ISO 7724/1, DIN 5033 Teil 7, ASTM E-1164 standard) with a brightness component L*, representative of how the material reflects light, between 60 and 90, preferably between 65 and 85 and, more preferably between 70 and 85.

The ceramic material has a hardness HV30 between 700 and 1900 according to the types and percentages of the constituents. More specifically, it has a hardness HV30 between 700 and 1300 when the carbide phase contains predominantly molybdenum carbide. A hardness HV30 between 900 and 1600 when the carbide phase contains predominantly tungsten carbide and a hardness HV30 between 700 and 1900 when the carbide phase contains predominantly titanium carbide.

The ceramic material has a tenacity $K_tc$ of at least 2 $MPa \cdot m^{1/2}$ with values potentially exceeding 20 $MPa \cdot m^{1/2}$. The tenacity is determined on the basis of the crack length measurements at the four ends of the diagonals of the Vickers hardness imprint according to the formula:

$$K_{1C} = 0.0319(P/al^{1/2})$$

where P is the load applied (N), a is the half-diagonal (m) and l is the measured crack length (m).

Tables 1 to 3 hereinafter contain various examples of cermets according to the invention.

27 powder mixtures were prepared in a mill in the presence of a solvent. The mixtures were produced without binder. They were compacted in chip form by uniaxial pressure and sintered in a vacuum or under a partial argon pressure between 5 and 100 mbar at a temperature which is dependent on the powder composition. After sintering, the samples were polished plane mechanically.

Table 1 contains tests No. 1 to 9 with a carbide phase comprising TiC, $Mo_2C$ or TiC and $Mo_2C$ and with a binder phase comprising Pd, Au or an Au alloy. For test 7, 0.5% of C is added to limit Mo formation.

Table 2 contains tests No. 11 to 18 with a carbide phase comprising TiC, TiC and Sic or Ti and $Mo_2C$ and with a binder phase comprising Pt or Pd. In test 16, the powder mixture contains an additive to improve densification. This additive is $Si_2Ti$ present in a weight percentage of 2%.

Table 3 contains tests No. 19 to 27 with a carbide phase comprising $Mo_2C$ or WC and with a binder phase comprising Pd, Pt, Ag, an Ag alloy or an Au alloy.

$HV_{30}$ hardness measurements were made on the surface of the samples and the tenacity was determined based on the hardness measurements as described above.

The Lab colorimetric values were measured on the polished samples with a KONICA MINOLTA CM-5 spectrophotometer under the following conditions: SCI (specular component included) and SCE (specular component excluded) measurements, inclination of 8°, 8 mm diameter MAV measurement zone.

It is apparent from these tests that the cermets with a carbide phase containing predominantly TiC have as a whole a greater hardness than that of the cermets with a carbide phase containing predominantly $Mo_2C$. The hardnesses are thus between 750 and 1800 HV30 for the cermets comprising TiC compared to values within the 750-1200 HV30 range for cermets comprising predominantly $Mo_2C$. Sample 4 containing TiC and an Au alloy has a lower hardness (761 HV30) attributed to a lower sintering time compared to sample 3 containing TiC and an Au alloy (1209 HV30). Sample 4 moreover has a lower tenacity compared to sample 3.

The cermets comprising $Mo_2C$ and Pd have extremely high tenacity values which are greater than 10 $MPa \cdot m^{1/2}$ for Pd contents greater than or equal to 8% (tests 6, 20, 21). For certain compositions, there are no crack propagations during the HV30 hardness measurements, hence a tenacity value could not be measured.

The cermets comprising predominantly $Mo_2C$ have high brightness indexes L* regardless of the type of precious binder used (Pt, Pd, Ag, Au—Cu) with values of the order of 80 as opposed to values within the 70-75 range for cermets comprising predominantly TiC.

A cermet composed solely of tungsten carbides, at a rate of 80% by mass, and of 20% palladium as precious metal binder, has a high hardness (1472 HV30) and a good tenacity (6.3 $MPa \cdot m^{1/2}$) which makes it a good candidate for producing functional parts such as an oscillating mass, also given the high density thereof.

Figure 2:
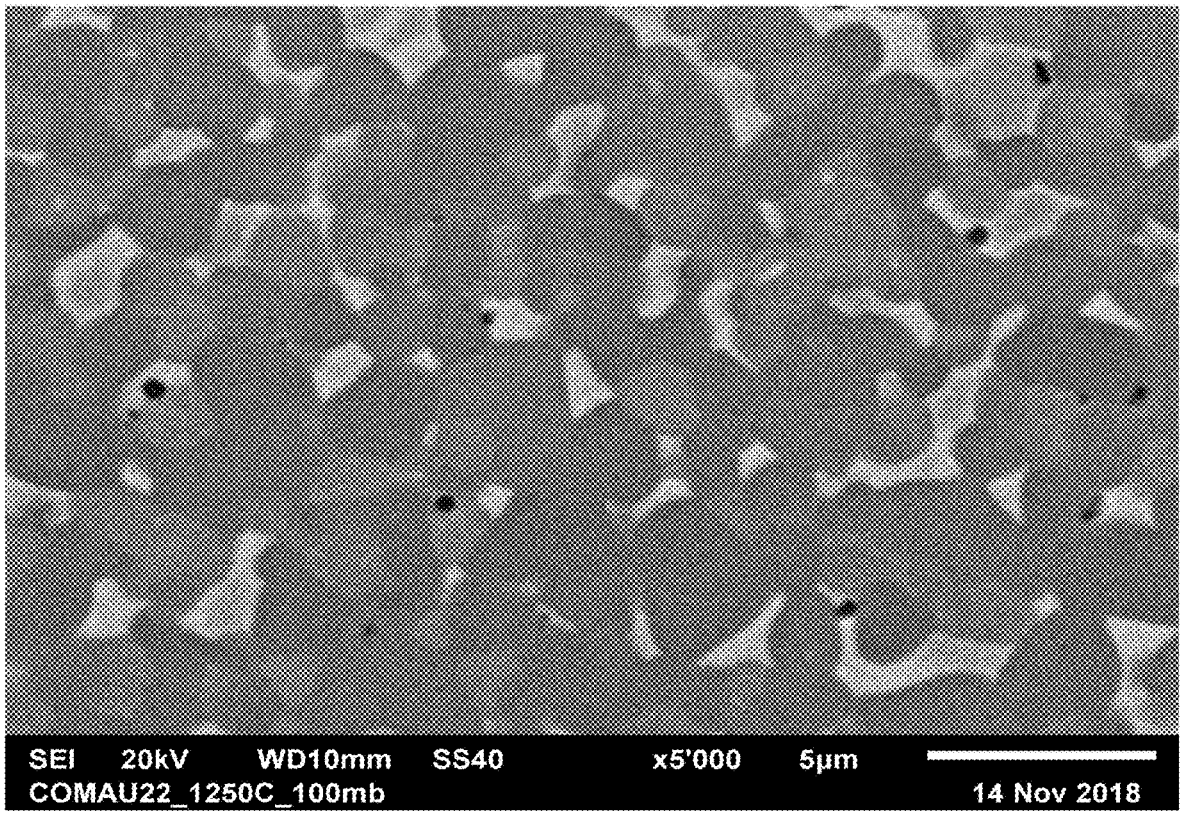
FIG. 2 represents an electron microscopy image of the cermet type material for a composition according to the invention (80% $Mo_2C$—15% Au and 5% Cu).

In terms of microstructures, FIG. 2 represents an electron microscopy image of a sintered sample from the powder mixture comprising 80% $Mo_2C$, 15% Au and 5% Cu by weight. The carbide phase is formed from the dark grey zone composed of $Mo_2C$ and the Mo-rich medium grey zone. Some of the $Mo_2C$ converted to Mo during sintering resulting in a decrease in hardness. The metallic phase AuCu is the white phase.

Figure 3:
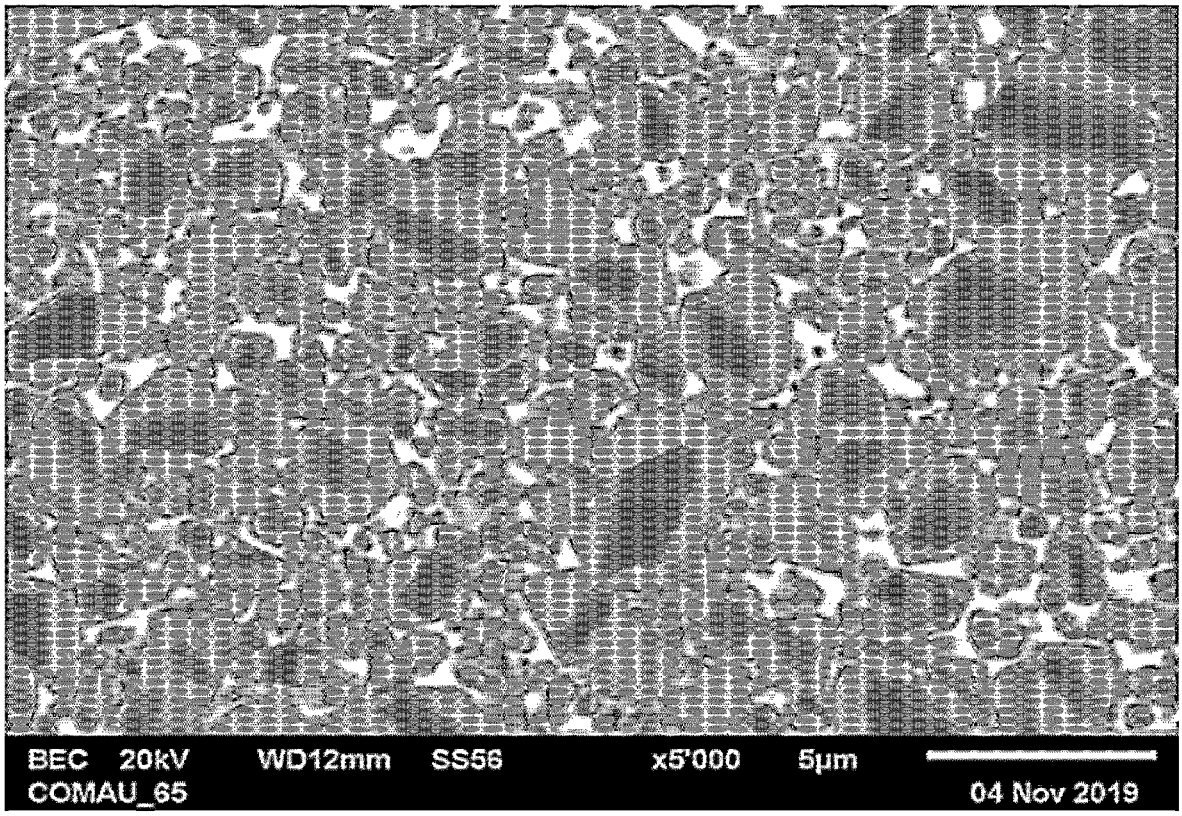
FIG. 3 represents an electron microscopy image of the cermet type material for a further composition according to the invention (80% TiC—2% SiC—18% Pt).

FIG. 3 represents an electron microscopy image of a sintered sample from the powder mixture comprising 80% TiC, 2% SiC and 18% Pt by weight. There is the carbide phase formed from the black and grey zones with the TiC-rich black zone and the grey zone comprising TiC and Pt. The metallic phase is in white.

As explained above, the invention relates to the component made of a cermet material. This component was devised for applications particularly in the field of watchmaking and jewellery such as for example elements of external parts or the movement of a timepiece. Obviously, the component according to the invention would not be restricted to watchmaking. Thus, by way of non-limiting example, it is also conceivable that this component can be applied in the field of tableware, cutlery, leatherware, or jewellery.

TABLE 1

| | Composition (wt) | | Size | Sintering | | Properties | | | | |
|---|---|---|---|---|---|---|---|---|---|---|
| | | | d50 | T | time | | KiC | | | |
| No. | Carbides | Binder | (μm) | (° C.) | (min) | HV30 | (MPa · m½) | L* | a* | b* |
| (1) | 84% TiC | 16% Pd | 0.68 | 1500 | 90 | 1583 | 6.1 | 70.39 | 0.69 | 4.29 |
| | 84% TiC | 16% Pd | 0.68 | 1700 | 90 | 1655 | 4.9 | / | / | / |
| (2) | 80% TiC | 15% Au—5% Cu | 0.72 | 1400 | 180 | 1256 | 6 | 73.02 | 0.85 | 1.15 |
| (3) | 80% TiC | 20% Au3N* | 0.50 | 1400 | 180 | 1209 | 7.5 | 73.10 | 0.75 | 1.37 |
| (4) | 79% TiC | 21% Au5N* | 0.76 | 1400 | 90 | 761 | 6.0 | 71.16 | 1.33 | 1.79 |

TABLE 1-continued

| Composition (wt) | | | Size | Sintering | | Properties | | | | |
|---|---|---|---|---|---|---|---|---|---|---|
| | | | d50 | T | time | | KiC | | | |
| No. | Carbides | Binder | (μm) | (° C.) | (min) | HV30 | (MPa · m½) | L* | a* | b* |
| (5) | 80% Mo2C | 15% Au—5% Cu | 0.89 | 1200 | 180 | 756 | 12.5 | 81.33 | 1.13 | 3.19 |
| | 80% Mo2C | 15% Au—5% Cu | 0.89 | 1250 | 180 | 766 | 12.6 | 81.17 | 1.15 | 3.34 |
| (6) | 86% Mo2C | 14% Pd | 0.69 | 1250 | 90 | 757 | >20 | 81.06 | 0.22 | 2.19 |
| | 86% Mo2C | 14% Pd | 1.69 | 1500 | 90 | 839 | >20 | 80.89 | 0.31 | 2.15 |
| (7) | 79.2% Mo2C | 15.2% Au—5.1% Cu—0.5% C | 0.90 | 1150 | 90 | 922 | 8.8 | 80.61 | 1.08 | 3.56 |
| | 79.2% Mo2C | 15.2% Au—5.1% Cu—0.5% C | 0.90 | 1450 | 90 | 984 | 4.9 | 80.79 | 0.74 | 3.13 |
| (8) | 84% Mo2C | 12% Au—4% Cu | 0.78 | 1150 | 90 | 874 | 11.4 | 80.88 | 0.92 | 3.16 |
| (9) | 20% Mo2C—60% TiC | 15.2% Au—4.8% Cu | 0.60 | 1300 | 90 | 1224 | 5.6 | 73.64 | 1.12 | 2.03 |
| | 20% Mo2C—60% TiC | 15.2% Au—4.8% Cu | 0.60 | 1450 | 90 | 1188 | 6.5 | 74.03 | 1.05 | 1.91 |

/ = not measured

*20% Au3N = 15% Au—3.2% Ag—1.8% Cu; 21% Au5N = 15.75% Au—4.2% Cu—1.05% Ag

TABLE 2

| Composition (wt) | | | Size | Sintering | | Properties | | | | |
|---|---|---|---|---|---|---|---|---|---|---|
| | | | d50 | T | time | | KiC | | | |
| No. | Carbides | Binder | (μm) | (° C.) | (min) | HV30 | (MPa · m½) | L* | a* | b* |
| (11) | 85% TiC | 15% Pt | 0.95 | 1400 | 60 | 1555 | 3.3 | 71.79 | −0.34 | −0.47 |
| | 85% TiC | 15% Pt | 0.95 | 1500 | 90 | 1720 | 3.1 | 71.95 | −0.32 | −0.57 |
| (12) | 90% TiC | 10% Pt | / | 1500 | 90 | 1746 | 2.1 | 72.87 | −0.07 | 0.15 |
| (13) | 80% TiC—2% SiC | 18% Pt | 0.32 | 1500 | 60 | 1561 | 3.0 | 73.14 | 0.08 | 0.24 |
| | 80% TiC—2% SiC | 18% Pt | 0.32 | 1650 | 60 | 1486 | 3.3 | 72.10 | −0.20 | −0.06 |
| (14) | 80% TiC—5% SiC | 15% Pt | 0.59 | 1400 | 60 | 1313 | 3.1 | 71.82 | 0.56 | 0.42 |
| | 80% TiC—5% SiC | 15% Pt | 0.59 | 1500 | 60 | 1498 | 2.7 | 72.49 | 0.52 | 0.35 |
| (15) | 80% TiC—10% SiC | 10% Pt | 0.73 | 1400 | 60 | 1528 | 2.7 | 70.96 | 0.37 | 0.25 |
| | 80% TiC—10% SiC | 10% Pt | 0.73 | 1500 | 60 | 1585 | 3.0 | 71.35 | 0.37 | 0.25 |
| (16) | 80% TiC—2% Si2Ti | 18% Pt | 1.43 | 1500 | 60 | 1605 | 3.2 | 72.82 | −0.11 | 0.12 |
| | 80% TiC—2% Si2Ti | 18% Pt | 1.43 | 1650 | 60 | 1497 | 3.4 | 71.59 | −0.35 | −0.41 |
| (17) | 77.5% TiC—7.5% Mo2C | 15.5% Pt | 1.10 | 1450 | 90 | 1755 | 3.4 | 72.21 | 0.19 | −0.17 |
| | 77.5% TiC—7.5% Mo2C | 15.5% Pt | 1.10 | 1650 | 60 | 1583 | 4.1 | 70.52 | 0.94 | 0.19 |
| (18) | 77.5% TiC—7.5% Mo2C | 15.5% Pd | 0.89 | 1450 | 60 | 1570 | 3.2 | 73.40 | 0.44 | 0.18 |
| | 77.5% TiC—7.5% Mo2C | 15.5% Pd | 0.89 | 1500 | 60 | 1561 | 3.1 | 72.94 | 0.40 | 0.10 |

TABLE 3

| Composition (wt) | | | Size | Sintering | | Properties | | | | |
|---|---|---|---|---|---|---|---|---|---|---|
| | | | d50 | T | time | | K1C | | | |
| No. | Carbide | Binder | (μm) | (° C.) | (min) | HV30 | (MPa · m½) | L* | a* | b* |
| (19) | 93% Mo2C | 7% Pt | 0.91 | 1650 | 30 | 1125 | 3.8 | 80.33 | 0.22 | 2.06 |
| (20) | 90% Mo2C | 10% Pd | 0.67 | 1350 | 90 | 710 | 12.0 | 80.78 | 0.17 | 1.83 |
| (21) | 92% Mo2C | 8% Pd | 0.86 | 1350 | 90 | 743 | 11.8 | 81.00 | 0.15 | 1.82 |
| (22) | 94% Mo2C | 6% Pd | 0.75 | 1350 | 90 | 893 | 3.6 | 81.21 | 0.11 | 1.94 |
| (23) | 78% Mo2C | 15% Au—5% Cu—2% C | 1.05 | 1400 | 60 | 1183 | 3.5 | 80.72 | 0.33 | 2.66 |
| (24) | 90% Mo2C | 10% Ag | 0.75 | 1400 | 60 | 962 | 4.6 | 81.02 | 0.34 | 1.95 |
| (25) | 92% Mo2C | 8% Sterling 925 Ag | 0.73 | 1300 | 90 | 887 | 4.6 | 81.12 | 0.49 | 2.50 |
| | 92% Mo2C | 8% Sterling 925 Ag | 0.73 | 1400 | 90 | 946 | 3.9 | 81.80 | 0.38 | 2.35 |
| (26) | 80% WC | 20% Pd | 2.85 | 1400 | 60 | 1472 | 6.3 | 75.81 | 0.13 | 0.38 |
| (27) | 90% WC | 7.5% Au—2.5% Cu | 0.58 | 1450 | 90 | 972 | 5.7 | 72.49 | 0.14 | 1.20 |
| | 90% WC | 7.5% Au—2.5% Cu | 0.58 | 1550 | 90 | 1486 | 4.3 | 73.82 | −0.01 | 0.67 |

The invention claimed is:

1. A non-ferromagnetic component, comprising:

a cermet material having a carbide phase consisting of at least one carbide selected from the group consisting of titanium carbide, molybdenum carbide, silicon carbide and niobium carbide;

$Si_2Ti$ or $Si_2Zr$; and a metallic binder phase comprising platinum, wherein the metallic binder phase is present in a range of from 3 to 24 wt. %, the carbide phase is present in a range of from 75 to 96 wt. %, the $Si_2Ti$ or $Si_2Zr$ is present in a range of from 1 to 3 wt. %, and the non-ferromagnetic component does not comprise ruthenium, nickel and cobalt.

2. The non-ferromagnetic component of claim 1, wherein the metallic binder phase is present in a range of from 3 to 21 wt. %, and the carbide phase is present in a range of from 78 to 96%.

3. The non-ferromagnetic component of claim 1, wherein the metallic binder phase is present in a weight percentage between 6 and 21% and the carbide phase is present in a weight percentage between 78 and 93%.

4. The non-ferromagnetic component of claim 1, wherein when the carbide phase consists of titanium carbide and at least one other carbide selected from the group consisting of molybdenum carbide, silicon carbide and niobium carbide as other carbides, the titanium carbide is present in a greater percentage than the other carbides, and when the carbide phase consists of molybdenum carbide and at least one other carbide selected from the group consisting of titanium carbide, silicon carbide and niobium carbide as other carbides, the molybdenum carbide is present in a greater percentage than the other carbides.

5. The non-ferromagnetic component of claim 1, wherein the carbide phase consists of titanium carbide and molybdenum carbide, wherein the titanium carbide is present in a greater percentage than the molybdenum carbide.

6. The non-ferromagnetic component of claim 1, wherein the carbide phase consists of titanium carbide and silicon carbide, wherein the titanium carbide is present in a greater percentage than the silicon carbide.

7. The non-ferromagnetic component of claim 1, wherein when the carbide phase consists of molybdenum carbide and at least one carbide selected from the group consisting of titanium carbide, silicon carbide and niobium carbide as other carbides, the molybdenum carbide is present in a greater percentage than the other carbides.

8. The non-ferromagnetic component of claim 1, having a hardness HV30 in a range of from 700 to 1900.

9. The non-ferromagnetic component of claim 1, wherein when the carbide phase consists of molybdenum carbide and at least one carbide selected from the group consisting of titanium carbide, silicon carbide and niobium carbide as other carbides, the molybdenum carbide is present in a greater percentage than the other carbides, the metallic binder phase comprises gold and copper, and a tenacity $K_{iC}$ of the non-ferromagnetic component is greater than or equal to 4 $MPa \cdot m^{1/2}$.

10. The non-ferromagnetic component of claim 1, wherein when the carbide phase consists of molybdenum carbide and at least one carbide selected from the group consisting of titanium carbide, silicon carbide and niobium carbide as other carbides, the molybdenum carbide is present in a greater percentage than the other carbides, the metallic binder phase comprises palladium, and a tenacity $K_{iC}$ of the non-ferromagnetic component is greater than or equal to 8 $MPa \cdot m^{1/2}$.

11. The non-ferromagnetic component of claim 1, having, in a CIELAB color space, a component L* in a range of from 60 to 90.

12. The non-ferromagnetic component of claim 1, wherein when the carbide phase consists of molybdenum carbide and at least one carbide selected from the group consisting of titanium carbide, silicon carbide and niobium carbide as other carbides, the molybdenum carbide is present in a greater percentage than the other carbides, and the non-ferromagnetic component has in a CIELAB color space, a component L* in a range of from 77 to 85.

13. The non-ferromagnetic component of claim 1, which is an external part component or movement in watchmaking.

14. The non-ferromagnetic component of claim 4, wherein the molybdenum carbide is present in a greater percentage than the other carbides and a hardness HV30 of the non-ferromagnetic component is in a range of from 700 to 1300.

15. The non-ferromagnetic component of claim 4, wherein the carbide phase consists of titanium carbide and silicon carbide, the titanium carbide is present in a greater percentage than the silicon carbide, and a hardness HV30 of the non-ferromagnetic component is in a range of from 1000 to 1900.

16. A non-ferromagnetic component comprising:

a cermet material comprising a carbide phase; $Si_2Ti$ or $Si_2Zr$; and a metallic binder phase of a metallic binder, wherein the $Si_2Ti$ or $Si_2Zr$ is present in a range of from 1 to 3 wt. %, the metallic binder consists of gold, platinum, palladium, rhodium, osmium, or an alloy thereof, the metallic binder phase is present in a range of from 6 to 24 wt. %, the carbide phase is molybdenum carbide and is present in a range of from 75 to 93 wt. %, and the non-ferromagnetic component is free from nickel and cobalt.

17. The component of claim 16, wherein the metallic binder phase is present in a range of from 6 to 21 wt. %, and the carbide phase is present in a range of from 78 to 93 wt. %.

18. The component of claim 16, having a hardness HV30 in a range of from 700 to 1900.

19. The component of claim 16, having a tenacity $K_{iC}$ greater than or equal to 2 $MPa \cdot m^{1/2}$.

20. The component of claim 16, having, in a CIELAB color space, a component L* in a range of from 60 to 90.

21. The component of claim 16, which is an external part component or movement in watchmaking.

* * * * *